US010712134B2

(12) United States Patent
Miani

(10) Patent No.: US 10,712,134 B2
(45) Date of Patent: Jul. 14, 2020

(54) ROCKET PROPELLED BULLET ASSEMBLY

(71) Applicant: Knoah Miani, St. Augustine, FL (US)

(72) Inventor: Knoah Miani, St. Augustine, FL (US)

( * ) Notice: Subject to any disclaimer, the term of this patent is extended or adjusted under 35 U.S.C. 154(b) by 172 days.

(21) Appl. No.: 15/949,113

(22) Filed: Apr. 10, 2018

(65) Prior Publication Data

US 2019/0310057 A1 Oct. 10, 2019

(51) Int. Cl.
*F42B 5/10* (2006.01)
*F42B 10/38* (2006.01)
*F42C 11/00* (2006.01)

(52) U.S. Cl.
CPC ..... *F42B 5/105* (2013.01); *F42B 5/10* (2013.01); *F42B 10/38* (2013.01); *F42C 11/00* (2013.01)

(58) Field of Classification Search
CPC .. F42B 5/10; F42B 5/105; F42B 10/38; F42B 10/40; F42C 11/00; F42C 7/00
USPC ..... 102/376
See application file for complete search history.

(56) References Cited

U.S. PATENT DOCUMENTS 2,613,604 A * 10/1952 Pyle ..... F42B 5/10 102/439
2,644,364 A * 7/1953 Nass ..... F42B 5/10 89/1.818
2,884,859 A 5/1959 Alexander
2,960,031 A 11/1960 Clift
2,989,922 A 6/1961 Greenwood
3,507,220 A * 4/1970 McClure ..... F42B 7/04 102/463
3,724,377 A * 4/1973 Birkigt ..... F42B 5/10 102/376
3,750,979 A * 8/1973 Nelms ..... F42B 5/10 244/3.24
3,903,802 A * 9/1975 Squiers ..... F42B 5/10 102/376
4,133,265 A * 1/1979 Diesinger ..... F42B 5/10 102/529
4,197,800 A * 4/1980 Greever ..... F42B 15/00 102/376
4,295,425 A * 10/1981 Davis ..... F42B 15/00 102/376
4,397,240 A * 8/1983 Rottenberg ..... F42B 15/00 102/376
4,461,214 A 7/1984 Black
7,603,951 B2 10/2009 Rose
(Continued)

FOREIGN PATENT DOCUMENTS

DE 2934848 A1 * 3/1981 ..... F42B 5/10
DE 3205431 A1 * 8/1983 ..... F42B 5/10
(Continued)

*Primary Examiner* — James S Bergin

(57) ABSTRACT

A rocket propelled bullet assembly for increasing the effective range of a gun includes a shell casing that is positioned in a chamber of a gun and the shell casing has an open end. A first propellant is contained in the shell casing and the first propellant is ignited when the gun is fired. A bullet is positioned in the open end of the shell casing. The bullet is fired from the shell casing when the first propellant is ignited and the bullet is projected from the gun. A rocket unit is integrated into the bullet and the rocket unit fires when the bullet is fired from the shell casing. The rocket unit increases a velocity of the bullet when the bullet is traveling thereby increasing a range of the bullet.

4 Claims, 2 Drawing Sheets

(56) References Cited

U.S. PATENT DOCUMENTS

| | | | | |
|---|---|---|---|---|
| 9,182,201 | B2 | 11/2015 | Coffman, II | |
| D780,876 | S | 3/2017 | Boatright | |
| 9,599,444 | B2 * | 3/2017 | Rachlin | F42B 5/02 |
| 9,823,053 | B1 * | 11/2017 | Fink | F42B 15/00 |
| 2011/0226149 | A1 * | 9/2011 | Tepe | F42B 10/40 102/376 |
| 2016/0282094 | A1 | 9/2016 | Brown | |

FOREIGN PATENT DOCUMENTS

| | | | | |
|---|---|---|---|---|
| FR | 2676805 | A1 * | 11/1992 | F42B 5/10 |
| GB | 2522788 | B * | 1/2016 | F42B 12/06 |

* cited by examiner

ROCKET PROPELLED BULLET ASSEMBLY

CROSS-REFERENCE TO RELATED APPLICATIONS

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art including Information Disclosed Under 37 CFR 1.97 and 1.98.

The disclosure and prior art relates to rocket devices and more particularly pertains to a new rocket device for increasing the effective range of a gun.

BRIEF SUMMARY OF THE INVENTION

An embodiment of the disclosure meets the needs presented above by generally comprising a shell casing that is positioned in a chamber of a gun and the shell casing has an open end. A first propellant is contained in the shell casing and the first propellant is ignited when the gun is fired. A bullet is positioned in the open end of the shell casing. The bullet is fired from the shell casing when the first propellant is ignited and the bullet is projected from the gun. A rocket unit is integrated into the bullet and the rocket unit fires when the bullet is fired from the shell casing. The rocket unit increases a velocity of the bullet when the bullet is traveling thereby increasing a range and impact energy of the bullet.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
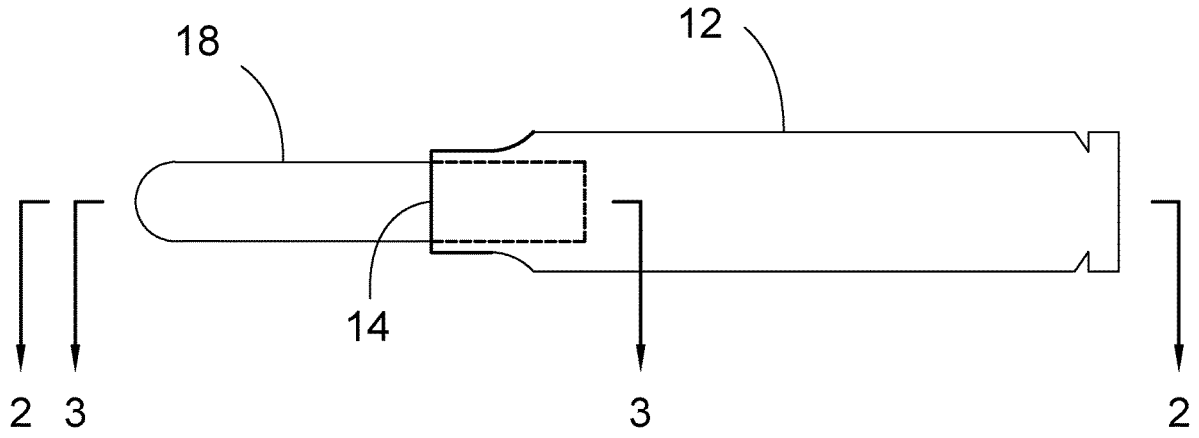
FIG. 1 is a perspective view of a rocket propelled bullet assembly according to an embodiment of the disclosure.
Figure 2:
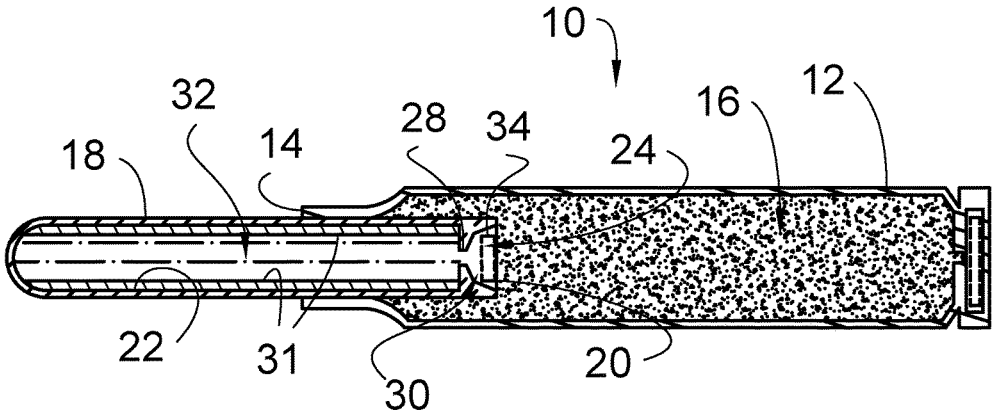
FIG. 2 is a cross sectional view taken along line 2-2 o FIG. 1 of an embodiment of the disclosure.
Figure 3:
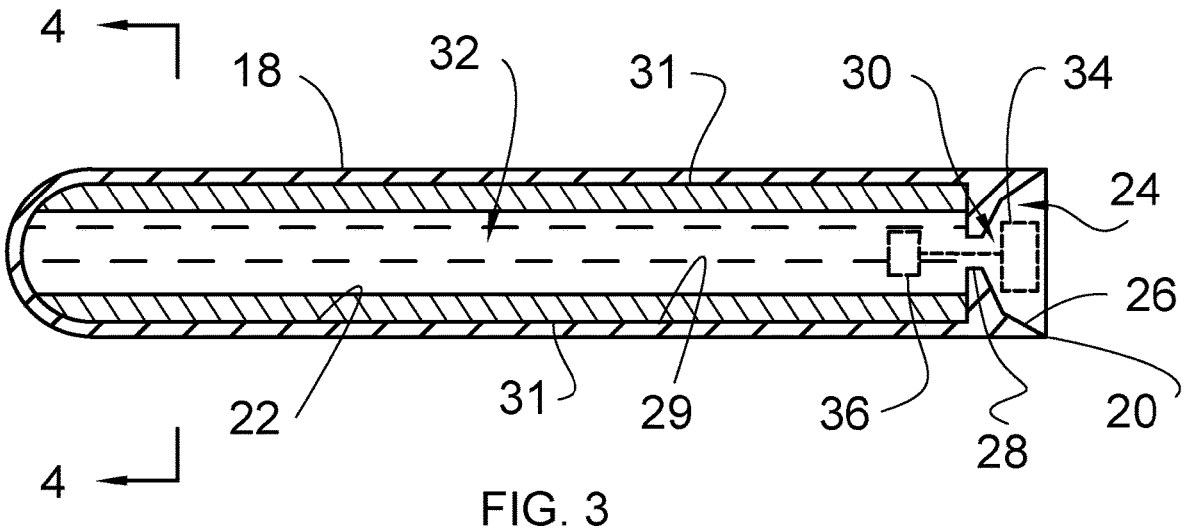
FIG. 3 is a cross sectional view taken along line 3-3 of FIG. 1 of an embodiment of the disclosure.
Figure 4:
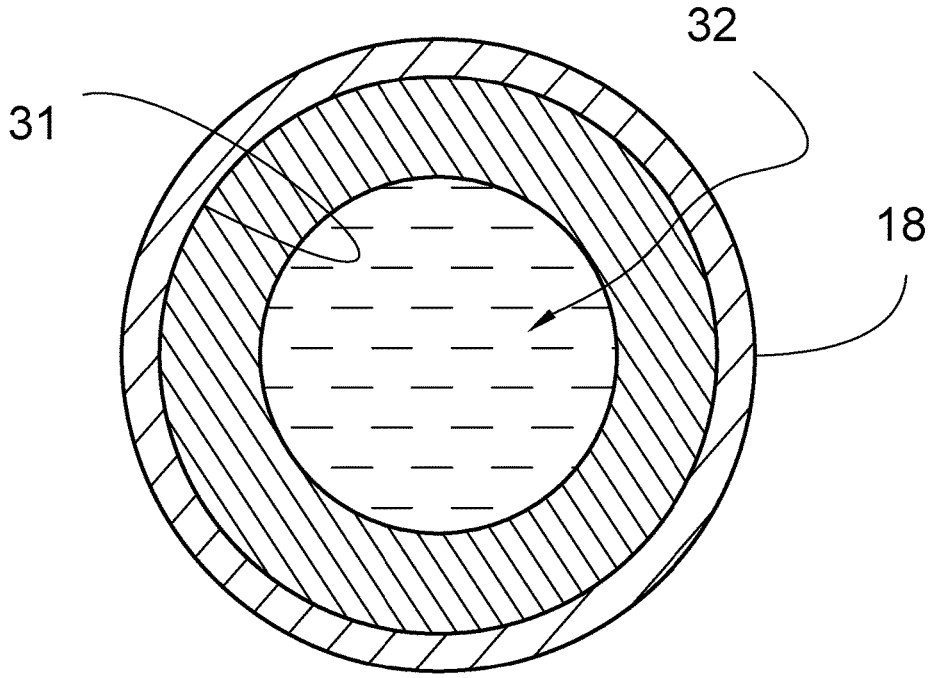
FIG. 4 is a cross sectional view taken along line 4-4 of FIG. 3 of an embodiment of the disclosure.

With reference now to the drawings, and in particular to FIGS. 1 through 4 thereof, a new rocket device embodying the principles and concepts of an embodiment of the disclosure and generally designated by the reference numeral 10 will be described.

As best illustrated in FIGS. 1 through 4, the rocket propelled bullet assembly 10 generally comprises a shell casing 12 that may be positioned in a chamber of a gun. The gun may be a rifle, a handgun and any other projectile based gun. The shell casing 12 has an open end 14 and the shell casing 12 may be a brass shell casing common to any conventional caliber of gun ammunition. A first propellant 16 is contained in the shell casing 12 and the first propellant 16 is ignited when the gun is fired. The first propellant 16 may be gun powder of any conventional design and volume.

A bullet 18 is provided and the bullet 18 is positioned in the open end 14 of the shell casing 12. The bullet 18 is fired from the shell casing 12 when the first propellant 16 is ignited such that the bullet 18 is projected from the gun. The bullet 18 has a first end 20 and the open end 14 of the shell casing 12 insertably receives the first end 20. The bullet 18 may be structured to correspond to any conventional caliber of gun ammunition.

The bullet 18 has a chamber 22 therein and the first end 20 has a well 24 extending toward the chamber 22. The well 24 has a bounding surface 26 and the bounding surface 26 tapers outwardly between the chamber 22 and the first end 20. In this way the well 24 is structured to define a rocket nozzle. Additionally, the bullet 18 has a conduit 28 extending between the chamber 22 and the well 24 such that the well 24 is in fluid communication with the chamber 22. The chamber 22 has a bounding surface 29 and a layer of weighted material 31, such as lead or the like, is bonded to the bounding surface 29 of the chamber 22. The amount of weighted material 31 will correspond to pre-determined mass requirements for desired ballistic performance.

A rocket unit 30 is provided and the rocket unit 30 is integrated into the bullet 18. The rocket unit 30 fires when the bullet 18 is fired from the shell casing 12. Moreover, the rocket unit 30 increases a velocity of the bullet 18 when the bullet 18 is traveling. In this way the rocket unit 30 increases a range and impact energy of the bullet 18 when the bullet 18 is fired from a conventional gun.

The rocket unit 30 comprises a second propellant 32 that is positioned in the chamber 22. The second propellant 32 may be rocket fuel, including solid rocket fuel and liquid rocket fuel, of any conventional design and volume. An igniter 34 is provided and the igniter 34 is positioned in the well 24. The igniter 34 ignites the second propellant 32 when the bullet 18 is fired from the shell casing 12. Moreover, the igniter 34 may be a miniaturized, electronic igniter 34 or the like and the igniter 34 may include a power source, such as a miniaturized battery or the like. A plurality of flaps may each be coupled to and extend away from the first end 20 of the bullet 18. The flaps surround the well 24 to increase directional stability of the bullet 18 when the second propellant 32 is ignited.

An accelerometer 36 is provided and the accelerometer 36 is positioned within the bullet 18. The accelerometer 36 is electrically coupled to the igniter 34. Moreover, the accelerometer 36 turns the igniter 34 on when the accelerometer 36 detects that the bullet 18 has exceeded a trigger velocity. The trigger velocity may be a velocity that corresponds to a muzzle velocity of traditional ammunition. In this way the igniter 34 is not turned on until after the bullet 18 has been fired from the gun. The accelerometer 36 may be a miniaturized electronic accelerometer 36 of any conventional design.

In use, the shell casing 12 and the bullet 18 are loaded into the chamber of the gun. The bullet 18 is fired in the conventional manner of firing a bullet 18 from the gun. The accelerometer 36 detects the acceleration of the bullet 18 when the bullet 18 is fired from the gun. Thus, the accelerometer 36 turns the igniter 34 on to ignite the second propellant 32 contained in the bullet 18. The second propellant 32 exits through the well 24 to propel the bullet 18 at a greater velocity than the muzzle velocity of traditional ammunition. In this way the effective range of a gun is increased without making any structural or functional changes to the gun itself.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A rocket propelled bullet assembly being configured to be fired from a projectile based gun, said assembly comprising:

a shell casing being configured to be positioned in a chamber of a gun, said shell casing having an open end;

a first propellant being contained in said shell casing wherein said first propellant is configured to be ignited when the gun is fired;

a bullet being positioned in said open end of said shell casing, said bullet being fired from said shell casing when said first propellant is ignited wherein said bullet is configured to be projected from the gun, said bullet having a first end, said open end of said shell casing insertably receiving said first end, said bullet having a chamber therein, said first end having a well extending toward said chamber to define a nozzle, said bullet having a conduit extending between said chamber and said well such that said well is in fluid communication with said chamber; and a rocket unit being integrated into said bullet, said rocket unit firing when said bullet is fired from said shell casing, said rocket unit increasing a velocity of said bullet when said bullet is traveling thereby increasing a range of and impact energy of said bullet, said rocket unit comprising a second propellant being positioned in said chamber, said rocket unit including an igniter, said igniter igniting said second propellant when said bullet is fired from said shell casing, said rocket unit including an accelerometer, said accelerometer being electrically coupled to said igniter, said accelerometer turning said igniter on when said accelerometer detects that said bullet has exceeded a trigger velocity.

2. The assembly according to claim 1, further comprising said igniter being positioned in said well.

3. The assembly according to claim 1, further comprising said accelerometer being positioned within said chamber.

4. A rocket propelled bullet assembly being configured to be fired from a projectile based gun, said assembly comprising:

a shell casing being configured to be positioned in a chamber of a gun, said shell casing having an open end;

a first propellant being contained in said shell casing wherein said first propellant is configured to be ignited when the gun is fired;

a bullet being positioned in said open end of said shell casing, said bullet being fired from said shell casing when said first propellant is ignited wherein said bullet is configured to be projected from the gun, said bullet having a first end, said open end of said shell casing insertably receiving said first end, said bullet having a chamber therein, said first end having a well extending toward said chamber to define a nozzle, said bullet having a conduit extending between said chamber and said well such that said well is in fluid communication with said chamber; and a rocket unit being integrated into said bullet, said rocket unit firing when said bullet is fired from said shell casing, said rocket unit increasing a velocity of said bullet when said bullet is traveling thereby increasing a range and impact energy of said bullet, said rocket unit comprising:

a second propellant being positioned in said chamber;

an igniter being positioned in said well, said igniter igniting said second propellant when said bullet is fired from said shell casing; and an accelerometer being positioned within said bullet, said accelerometer being electrically coupled to said igniter, said accelerometer turning said igniter on when said accelerometer detects that said bullet has exceeded a trigger velocity.

* * * * *